US007672472B2

(12) United States Patent
Oxford et al.

(10) Patent No.: US 7,672,472 B2
(45) Date of Patent: Mar. 2, 2010

(54) AUDIO TRANSDUCER

(75) Inventors: J. Craig Oxford, Nashville, TN (US); D. Michael Shields, St. Paul, MN (US)

(73) Assignee: Iroquois Holding Co., Nashville, TN (US)

( * ) Notice: Subject to any disclaimer, the term of this patent is extended or adjusted under 35 U.S.C. 154(b) by 1016 days.

(21) Appl. No.: 11/324,652

(22) Filed: Jan. 3, 2006

(65) Prior Publication Data

US 2007/0154028 A1 Jul. 5, 2007

(51) Int. Cl.
*H04R 1/00* (2006.01)
*H04R 9/06* (2006.01)
*H04R 25/00* (2006.01)

(52) U.S. Cl. ..... 381/423; 381/186; 381/430

(58) Field of Classification Search ..... 381/182, 381/186, 400, 405, 423, 430; 181/163–165
See application file for complete search history.

(56) References Cited

U.S. PATENT DOCUMENTS 5,464,948 A * 11/1995 Lace ..... 84/726
6,061,461 A * 5/2000 Paddock ..... 381/424
6,816,598 B1 * 11/2004 Budge ..... 381/89
2005/0180577 A1 * 8/2005 Horbach ..... 381/27

* cited by examiner

*Primary Examiner*—Tuan D Nguyen
(74) *Attorney, Agent, or Firm*—Wayne Edward Ramage; Baker Donelson

(57) ABSTRACT

An audio transducer for use in a loudspeaker system. The transducer includes a rigid base, a pair of flexible, curved diaphragms and each diaphragm having a distal end and a proximal end. The curved diaphragms form hemi-cylindrical lobes being substantially tangent to one another at their proximal ends and are attached to energy absorbent dampers at their distal ends. The transducers can be employed in a line array as part of the loudspeaker system as well as some of the transducers facing forward while others rearward and, in doing so, their amplitudes and phases can be adjusted for fine tailoring the geometric coverage of acoustic energy radiating from the loudspeaker system.

16 Claims, 5 Drawing Sheets

AUDIO TRANSDUCER

TECHNICAL FIELD

The present invention relates to audio transducers and specifically audio transducers having a pair of hemi-cylindrical lobes and loudspeaker systems employing such transducers in tailoring geometric coverage of acoustic radiation emanating from such a loudspeaker system.

BACKGROUND OF THE INVENTION

The vast majority of audio transducers employ cylindrical diaphragms formed from flat sheets that are curved so that all lines normal to the curved surface remain perpendicular to the longitudinal axis of the diaphragm. Although such transducers are most common, there are many other forms of acoustic energy generating devices such as those disclosed in International Publication No. WO93-23967 and U.S. Pat. No. 5,249,237.

A significant departure from those diaphragms created from flat sheets are those disclosed in U.S. Pat. No. 6,061,461, the disclosure of which is incorporated by reference herein. Transducers disclosed in the '461 patent are especially useful as high frequency or tweeter transducers that are not necessarily limited to the reproduction of high frequencies. These transducers include a rigid frame and a permanent ring magnet mounted to the frame and a small bobbin, preferably formed of aluminum foil sized and arranged to fit within the open end of a magnetic gap while providing motion of the bobbin therein. A voice coil is wound on the bobbin and connectable to receive an audio signal similar to a conventional voice coil driver system. What is unique to the '461 patented invention is the use of flexible, curved diaphragms disposed in a frame generally free to move except for the distal end of each diaphragm which is fixed to the frame of the transducer. The proximal ends of the diaphragms are connected together in a spaced relationship by a pliable decoupling pad, preferably formed of a closed-cell foam tape for decoupling the diaphragms from one another while enabling them to be driven with a single voice coil driver assembly.

Although the transducers described in the '461 patent provide excellent high frequency response and dispersion of acoustic energy, such transducers are not free of faults. In sum, the transducer to be described herein constituting the present invention is capable of smooth amplitude-frequency response, high electro acoustic conversion efficiency, wide dispersion of sound output and low distortion. Transducers of the present invention when operated above approximately 2 kHz represent a marked improvement over direct-radiator transducers which employ rigid diaphragms and are therefore, by necessity, very small. At high amplitudes the rigidity of such diaphragms usually fail in unpredictable modes and the result is non-uniform response in both amplitude and dispersion. As was the case with the '461 transducer, the present invention makes use of the propagation of bending waves in a non-rigid material. In this type of transducer, the properties of the diaphragm material are exploited rather than design limitations to be overcome.

SUMMARY OF THE INVENTION

The present invention is directed to an audio transducer comprising a rigid frame, a pair of flexible, curved diaphragms each having a distal end and a proximal end, said curved diaphragms forming a pair of hemi-cylindrical lobes being substantially tangent to one another at their proximal ends and a pair of energy absorbing dampers appended to said frame and connected to the distal end of the curved diaphragms. A cylindrical cup is provided located proximate the proximal ends of the curved diaphragms, the cylindrical cup housing a permanent magnet and a pole tip forming an annular gap at an open end of the cylindrical cup. A focusing magnet is further provided being mounted to the pole tip opposite the permanent magnet. A voice coil is wound on an aluminum form and placed within the gap for moving the pair of flexible curved diaphragms in response to audio frequency currents received by the audio transducer from a signal source.

The audio transducer described above can be employed in a full range loudspeaker system preferably as the tweeter or high frequency transducer of such system although not necessarily so. Multiple such transducers can be arranged in a line-array while it is contemplated, as a preferred embodiment, that some of such transducers face forward and some rearward of the loudspeaker system cabinet whereby amplitudes and/or phase of these transducers can be selected to fine tailor geometric coverage of acoustic radiation emanating from the loudspeaker system.

DETAILED DESCRIPTION OF THE INVENTION

Figure 1:
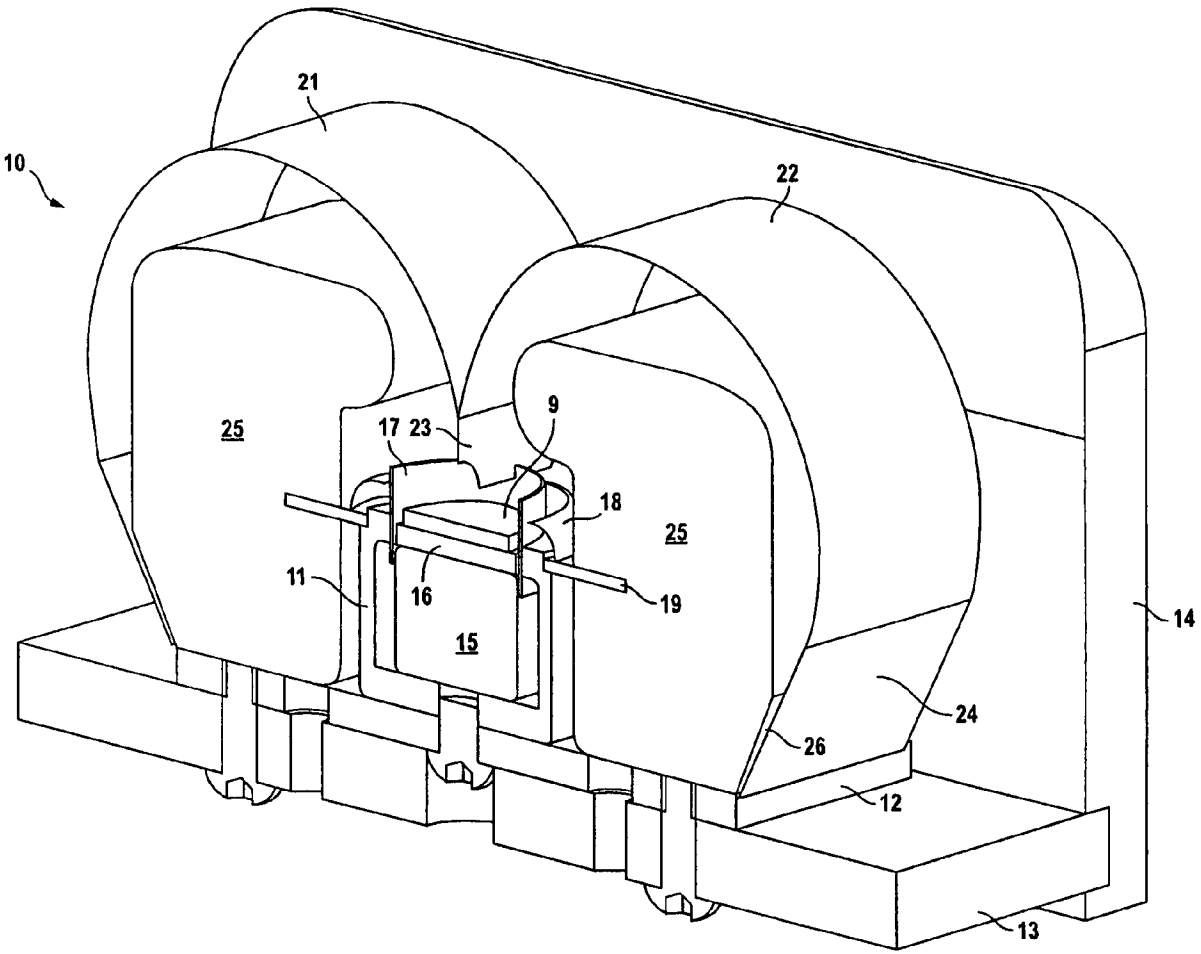
FIG. 1 is a perspective cross-sectional view of the transducer of the present invention.

Turning first to FIG. 1, transducer 10 is depicted in cross-section in order to enable one to visualize its internal components. The present transducer is applied to a rigid frame which is shown as base plate 12 which can optionally be secured to vertically and horizontally extending housing components 13 and 14, respectively. These latter elements can be part of the loudspeaker system that makes use of the presently described transducer 10.

In constituting the component parts of transducer 10, reference is first made to magnetic permeable cup 11 housing, for example, a neodynium, iron boron high intensity primary magnet 15. Magnet 15 causes a strong stationary magnetic field to exist in the gap formed between pole tip 16 and the upper end of magnetic permeable cup 11. A voice coil is constructed and made a part of voice coil form 17 constructed ideally of copper-coated aluminum wire (for reduced mass compared to copper wire, alone). When alternating current from a signal source such as an audio amplifier is passed through the voice coil winding, the resulting magnetic field alternately draws the voice coil form 17 into cup 11 and pushes it out of cup 11. The resulting reciprocating motion of the coil drives diaphragms 21 and 22. In addition, focusing magnet 9 can be mounted to the pole tip opposite main magnet 15 in order to concentrate the flux in the gap.

In again referring to FIG. 1, transducer 10 also includes spider 18 which is a flexible fabric circle with circumferential corrugations attached at its inner diameter to the voice coil and its outer diameter to spider/damper platform 19. The spider/damper platform 19 is stationary and is mounted to the outside of magnetic permeable cup 11 and establishes the static elevation of the coil within voice coil form 17 and maintains is concentricity with pole tip 16 and therefore its centering within the gap. Further, the flexibility of spider/damper platform 19 permits axial movement of the voice coil.

As an optional expedient, magnetic fluid can be introduced into the gap on both the inside and outside of voice coil form 17, this magnetic fluid common to transducer fabrication and consists of a viscous fluid which contains magnetically active microscopic particles suspended in the fluid and captured by the magnetic flux in the gap. This prevents the migration of the fluid which is employed to assist in keeping voice coil form 17 centered within the gap and dampens unwanted lateral motions such as "rocking" of the voice coil and is also used to transfer heat from the voice coil during operation of the transducer.

Figure 5:
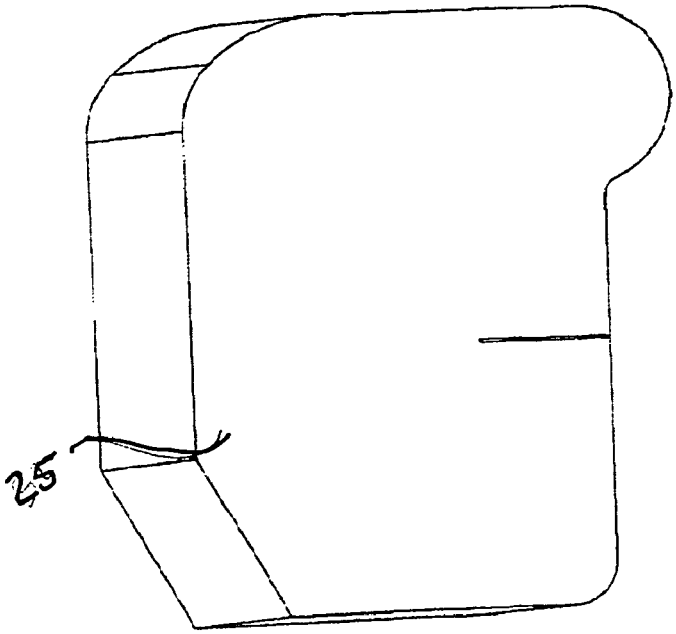
FIG. 5 is a perspective view of the reticulated foam dampers employed in constructing the transducers of the present invention.

As noted previously, transducer 10 includes flexible diaphragms 21 and 22 having proximal ends 23 and distal ends 24. Diaphragms 21 and 22 form two lobes which are connected at their distal ends to damper foam blocks 25 shown both in FIGS. 1 and 5. Damper foam blocks 25 absorb sound radiated from the back side of diaphragms 21 and 22. As noted again in reference to FIG. 1, the surfaces of damper foam blocks 25 are not, throughout their outer edges, equidistant from the inner surfaces of diaphragms 21 and 22. This design feature is intentional to spread out the frequency distribution of any residual reflections which might occur during imperfect absorbency of damper foam 25 to the acoustic energy generated on the back side of diaphragms 21 and 22. Further, distal end 24 of diaphragms 21 and 22 are appended to damper foam 25 at interface 26 which is preferable to terminating distal ends 24 to base plate 12 because any remaining wave propagation in the diaphragm needs to be absorbed at distal end 24. A hard termination, such as that suggested in the '461 patent will reflect this energy back into diaphragms 21 and 22 causing undesirable vibrations in response.

Figure 2:
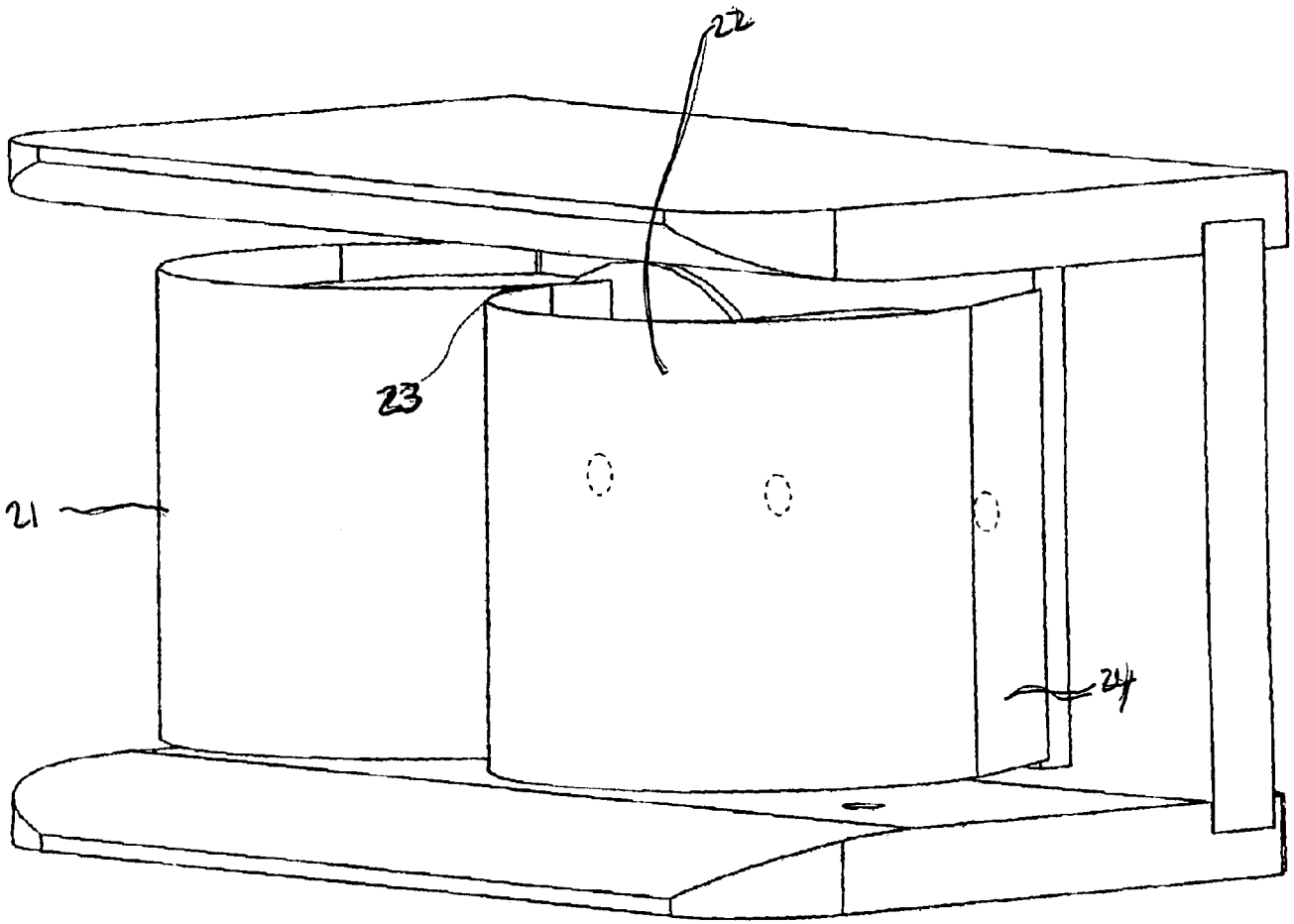
FIG. 2 is a perspective view of the transducer of FIG. 1.

Once again referring to FIG. 1, it is noted that magnetic permeable cup 11 is mounted to base plate 12 as are the bottom surfaces of damper foam 25. As such, the entire assembly is supported by base plate 12 which can be, as noted previously, appended to optional housing elements 13 and 14. This is shown in FIG. 2 whose component parts correspond to those described with regard to FIG. 1.

Figure 3:
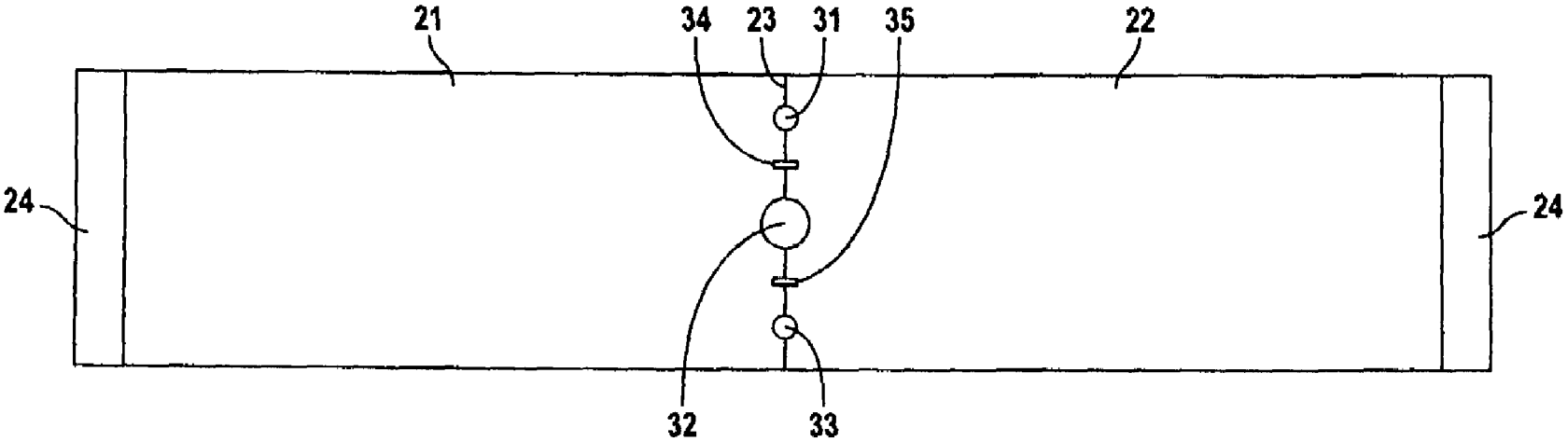
FIG. 3 is a top plan view of the diaphragm film employed in constructing the transducer of the present invention.

As noted in reference to FIG. 3, diaphragms 21 and 22 can be constructed from a single rectangular die-cut film constructed with three holes 31, 32 and 33 and two small slots 34 and 35 where diaphragms 21 and 22 extend tangentially to one another at their proximal ends. In order to maintain the folded film in the form shown herein, a two mil. closed-cell foam tape can be applied to the inside of the fold at proximal end 23. The 2 mil. spacer provided by the tape prevents any possibility of diaphragms 21 and 22 touching one another during operation which could cause "buzzing." The resulting stiff structure at proximal end 23 is the point in which diaphragms 21 and 22 are driven by the voice coil. The two small slots match the diameter of the voice coil and are engaged by it and secured with activated cyanoacrylate adhesive. The two diaphragms 21 and 22 then curve backwards and their distal ends 24 are attached to damper foam blocks 25 (FIG. 1) either by pressure sensitive adhesive or by activated cyanoacrylate or other suitable adhesive. As a preferred embodiment, diaphragms 21 and 22 are made from polyetheramide film, typically 3 mils. thick. For appearance, a matt finish can be applied to the front side of diaphragms 21 and 22.

It should be pointed out that holes 31, 32 and 33 take on the appearance of notches when the rectangular film producing diaphragms 21 and 22 is laid flat before folding. Holes 31, 32 and 33 serve two purposes, namely, to remove moving mass near the proximal ends of diaphragms 21 and 22, in other words, at their point of drive to improve high frequency response and to slightly weaken the mechanical beam which is produced by the fold at proximal end 23 and the foam tape. This causes slight flexure when diaphragms 21 and 22 are driven and causes the driving force to be imparted to the film isophasically. In turn, this causes wave propagation in the film to be slightly disorganized, or chaotic, which causes the radiation to be slightly diffuse. The beneficial consequence of this is that the vertical dispersion is wider than would occur if the film were vibrating isophasically. Other means of creating isophasic vibration could also be employed besides configuring holes 31, 32 and 33 at proximal ends 23 and their employment is considered to be part of the present invention.

Figure 4:
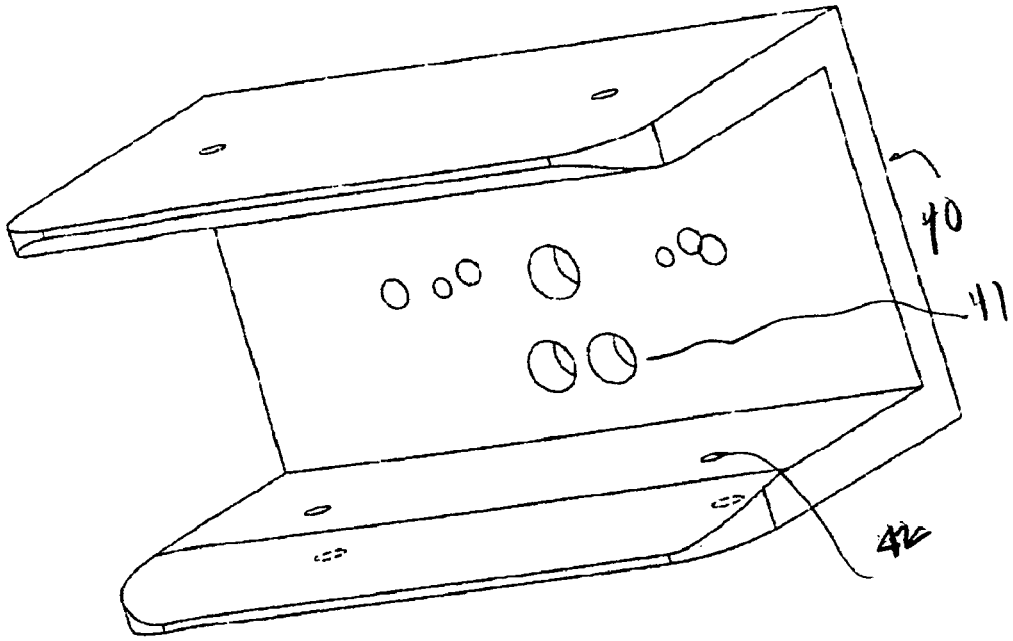
FIG. 4 is a perspective view of the frame or housing of the transducer of the present invention.

FIG. 4 depicts a typical rigid frame 40 for receiving the various functional components described above. As noted, various holes 41 can be tapped within frame 40 for receiving suitable audio frequency currents from an audio amplifier (not shown) employed for driving the present transducer. Holes 42 can also be provided for attaching frame 40 to a suitable loudspeaker.

As noted previously, FIG. 5 depicts damper foam 25 described previously with reference to FIG. 1. Suitably, damper foam 25 can consist of reticulated urethane foam although other materials could be employed which have the necessary structural rigidity and acoustical wave absorbing characteristics preferable exhibited for the purposes described above.

Figure 6:
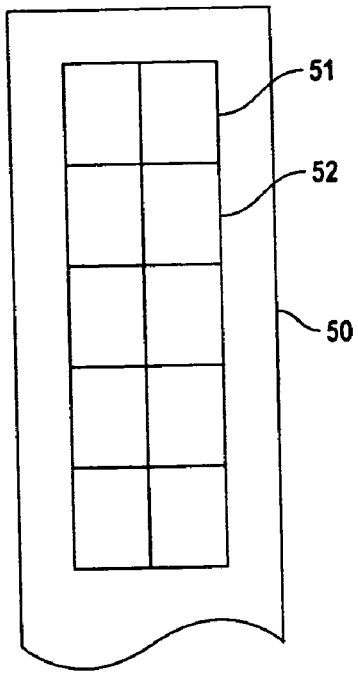
FIG. 6 depicts the plan view of a portion of a loudspeaker cabinet showing the transducers of the present invention in line array.

Reference is next made to FIG. 6. In employing transducer 10 in a loudspeaker system, the transducer can be ideally employed to provide high frequency output (above approximately 2 kHz) or could be used to convey other frequencies within the audio spectrum. In either case, because present transducers 15 are maintained on base plate 12 (FIG. 1), they can be placed quite close to one another in a line array. This configuration is illustrated in FIG. 6 showing the line array of transducers 51, 52, etc. within loudspeaker housing 50. When so arranged, an effectively unbroken vertical diaphragm having an arbitrary length is possible which closely approaches a true line source.

Figure 7:
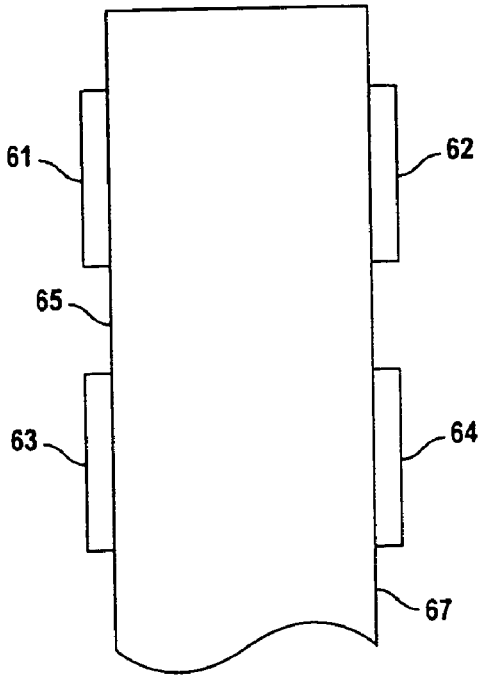
FIG. 7 shows a side plan view of a portion of a loudspeaker cabinet showing the present transducers positioned for ratio metric drive.

Reference is now made to FIG. 7 showing speaker enclosure 60 from its side view. As noted, transducer 61 and 63 can be placed upon surface 65 facing a listener while transducers 62 and 64 can be configured upon surface 67 away from a listener. Any number of transducers can be so employed and driven in various ways to accomplish certain design criteria sought after herein. Specifically, transducer 61, 62, 63 and 64 etc. can be driven with equal in-phase signals to enable loudspeaker 60 to closely approach a perfectly omni directional radiation pattern in a horizontal plane. When this degree of omni directionality is not required (or desired) it is possible to drive, for example, transducer 61 and 63 within phase voltages with transducer 62 and 64 but with different amplitudes. This will result in a radiation pattern in the horizontal plane which is very broad but still possesses some preferential directivity. Alternately, introducing either pure delay or frequency-dependent phase shift between the electrical signals provided to transducers 61 and 63 as compared to those provided to transducers 62 and 64 can produce a wide range of directional characteristics according to the system design requirements.

The invention claimed is:

1. An audio transducer comprising a rigid base, a pair of flexible, curved diaphragms each having a distal end and a proximal end, said curved diaphragms forming a pair of hemi-cylindrical lobes being substantially tangent to one another at their proximal ends, a pair of energy absorbent dampers appended to said base and connected to the distal ends of said curved diaphragms, a cylindrical cup located proximate the proximal ends of said curved diaphragms, said cylindrical cup housing a permanent magnet and a pole tip forming an annular gap at an open end of said cylindrical cup, a focusing magnet mounted to said pole tip opposite said permanent magnet and a voice coil wound on an aluminum form and placed within said gap for moving said pair of flexible curved diaphragms in response to audio frequency currents received by said audio transducer from a signal source.

2. The audio transducer of claim 1 wherein said audio transducer is employed in a full range loudspeaker system.

3. The audio transducer of claim 2 wherein said audio transducer is employed as a high frequency transducer within said loudspeaker system.

4. The audio transducer of claim 2 wherein multiple audio transducers are arranged in a line-array of multiple identical transducers as part of said loudspeaker system.

5. The audio transducer of claim 2 wherein at least two said audio transducers are employed in said loudspeaker system, at least one such audio transducer facing forward and at least one such audio transducer facing rearward of said loudspeaker system.

6. The audio transducer of claim 5 wherein at least one forward facing transducer and at least one rearward facing transducer are operated with different amplitudes for tailoring geometric coverage of acoustic radiation emanating from said loudspeaker system.

7. The audio transducer of claim 5 wherein said at least one forward facing transducer and at least one rearward facing transducer are operated with different phases for tailoring geometric coverage of acoustic radiation emanating from said loudspeaker system.

8. The audio transducer of claim 1 wherein holes are configured within said curved diaphragms at their proximal ends to encourage their isophasic vibration when driven by audio frequency currents.

9. A loudspeaker system for converting audio frequency currents to audible sound energy, said loudspeaker system comprising a pair of cabinets and at least two audio transducers supported by each such cabinet, each of said audio transducers comprising a rigid base, a pair of flexible curved diaphragms each having a distal end and a proximal end, said curved diaphragms forming a pair of hemi-cylindrical lobes being substantially tangent to one another at their proximal ends and capable of moving in response to the receipt of audio frequency currents from a power amplifier, a cylindrical cup located proximate the proximal ends of said curved diaphragms, said cylindrical cup housing a magnet and a pole tip forming an annular gap, a voice coil positioned within said annular gap, and a focusing magnet affixed to said pole tip.

10. The loudspeaker system of claim 9 wherein said audio transducers are employed in a full range loudspeaker system.

11. The loudspeaker system of claim 10 wherein said audio transducers are employed as high frequency transducers within said loudspeaker system.

12. The loudspeaker system of claim 9 wherein said at least two audio transducers are arranged in a line-array of multiple identical transducers.

13. The loudspeaker system of claim 9 wherein at least one of said two audio transducers faces forward and at least one of said at least two audio transducers faces rearward of said cabinet.

14. The loudspeaker system of claim 13 wherein said at least one of said forward facing transducers and at least one of said rearward facing transducers are operated with different amplitudes for tailoring geometric coverage of acoustic radiation emanating from said loudspeaker system.

15. The loudspeaker system of claim 13 wherein said at least one of said forward facing transducers and at least one of said rearward facing transducers are operated with different phases for tailoring geometric coverage of acoustic radiation emanating from said loudspeaker system.

16. An audio transducer, comprising: a pair of curved diaphragms, each having a distal end and proximal end, said diaphragms forming a pair of hemi-cylindrical lobes substantially tangent to each other at their proximal ends; one or more energy absorbent dampers positioned inside one or both the diaphragms, wherein said dampers are in contact with said diaphragms only at their proximal or distal ends; a cylindrical cup located proximate the proximal ends of said curved diaphragms, said cylindrical cup housing a magnet and a pole tip forming an annular gap, a voice coil positioned within said annular gap, and a focusing magnet affixed to said pole tip.

* * * * *